US005401936A

United States Patent [19]

Kusaka et al.

[11] Patent Number: 5,401,936

[45] Date of Patent: Mar. 28, 1995

[54] HEATING APPARATUS USING HEATER HAVING HEAT-RESISTIVE RESIN LAYER

[75] Inventors: Kensaku Kusaka, Kawasaki; Akira Yamamoto, Tokyo; Shigeo Kimura, Yokohama; Atsushi Hosoi, Kawasaki, all of Japan

[73] Assignee: Canon Kabushiki Kaisha, Tokyo, Japan

[21] Appl. No.: 101,824

[22] Filed: Aug. 4, 1993

Related U.S. Application Data

[63] Continuation of Ser. No. 668,166, Mar. 12, 1991, abandoned.

[30] Foreign Application Priority Data

Mar. 13, 1990 [JP] Japan ..... 2-63890

[51] Int. Cl.[6] ..... G03G 15/20

[52] U.S. Cl. ..... 219/216; 355/289

[58] Field of Search ..... 355/282, 285, 289, 290; 219/216, 469

[56] References Cited

U.S. PATENT DOCUMENTS

| | | | |
|---|---|---|---|
| 3,578,797 | 5/1971 | Hodges et al. | 219/388 X |
| 3,810,735 | 5/1974 | Moser | 219/216 X |
| 3,811,828 | 5/1974 | Ohta et al. | 219/216 X |
| 4,335,389 | 6/1982 | Shirato et al. | 346/140 R |
| 4,566,779 | 1/1986 | Coli et al. | 355/212 |
| 4,780,742 | 10/1988 | Takahashi et al. | 355/290 |
| 4,954,845 | 9/1990 | Yano et al. | 355/290 |
| 4,998,121 | 3/1991 | Koh et al. | 346/160 |
| 5,026,276 | 6/1991 | Hirabayashi et al. | 219/216 X |
| 5,027,160 | 6/1991 | Okada et al. | 355/282 |
| 5,043,763 | 8/1991 | Koh et al. | 355/285 X |
| 5,051,784 | 9/1991 | Yamamoto et al. | 355/285 |
| 5,083,168 | 1/1992 | Kusaka et al. | 355/285 |
| 5,241,155 | 8/1993 | Koh et al. | 219/216 |

FOREIGN PATENT DOCUMENTS

| | | |
|---|---|---|
| 51-29825 | 3/1976 | Japan . |
| 0112834 | 6/1985 | Japan . |

OTHER PUBLICATIONS

Fink et al., Standard Handbook for Electrical Engineers, 1978.

Hirabayashi et al, EPA #295,901, Dec. 1988.

*Primary Examiner*—Robert B. Beatty

*Attorney, Agent, or Firm*—Fitzpatrick, Cella, Harper & Scinto

[57] ABSTRACT

A heating apparatus includes a heater; a film in slidable contact with the heater and movable together with a recording material carrying an image, such that the image is heated by heat from the heater through the film. The heater is provided with a heat resistive resin layer for sliding contact with the film.

14 Claims, 2 Drawing Sheets

HEATING APPARATUS USING HEATER HAVING HEAT-RESISTIVE RESIN LAYER

This application is a continuation of application Ser. No. 07/668,166, filed Mar. 12, 1991, now abandoned.

FIELD OF THE INVENTION AND RELATED ART

The present invention relates to a heating apparatus usable with an image forming apparatus such as a copying machine or a photoprinter to fix an unfixed image or to improve the surface property of the image.

In a widely used conventional image fixing apparatus wherein the toner image is fixed on the recording material supporting an unfixed toner image, the recording material is passed through a nip formed between a heating roller maintained at a predetermined temperature and a pressing or back-up roller having an elastic layer and press-contacted to the heating roller.

A belt type heating system using an endless belt is also known and disclosed in U.S. Pat. No. 3,578,797 or Japanese Patent Application Publication No. 29825/1976.

These machines involve the problem that they require a relatively longer warming-up period until it becomes operable.

U.S. Ser. Nos. 206,767, 409,341, 416,539, 426,082, 435,247, 430,437, 440,380, 440,678, 444,802 and 446,449 which have been assigned to the assignee of this application, have proposed a novel image fixing apparatus using a stationary heater and a thin film slidable relative to the heater, by which the warming-up period is significantly reduced or eliminated. In this type of fixing apparatus, a heat generating resistor material of the heater is coated with glass.

In the structure where the film slides on the heater, the inside surface of the film is abraded to produce powdery matter with the result of an increase in the driving torque for the film.

Particularly, when the heat generating resistor material producing heat upon the electric power supply thereto is coated with a glass protection layer, the surface of the glass is not smooth because the glass protection layer is formed by printing glass dispersion on the substrate and sintering it. When the surface thereof is rubbed with the film, the film is damaged with the result of quick wearing.

SUMMARY OF THE INVENTION

Accordingly, it is a principal object of the present invention to provide a heating apparatus wherein the wearing of the film, caused by the sliding action between the heater and the film, is small.

It is another object of the present invention to provide a heating apparatus wherein the frictional force between the heater and the film is smaller.

It is a further object of the present invention to provide a heating apparatus wherein that surface of the heater which is slidable on the heater is coated with heat resistive resin material.

It is a yet further object of the present invention to provide a heating apparatus wherein that surface of the heater which is contactable to the heater is coated with a heat resistive resin material containing a highly heat-conductive material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
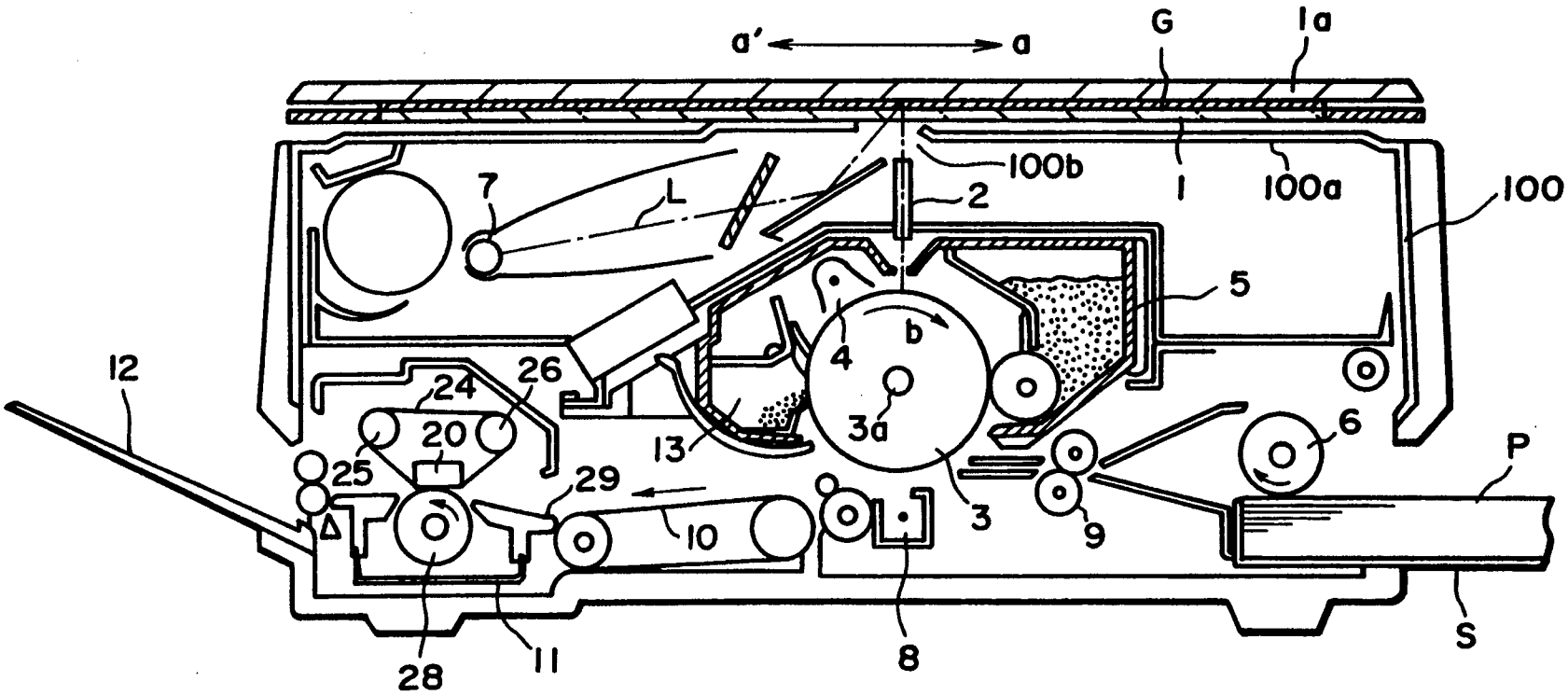
FIG. 1 is a sectional view of an image forming apparatus using a heating apparatus according to an embodiment of the present invention.

The preferred embodiments of the present invention will be described in conjunction with the accompanying drawings wherein like reference numerals are assigned to the elements having the corresponding functions.

As shown in FIG. 1, an exemplary image forming apparatus comprises a casing 100, and a reciprocable original carriage 1 made of a transparent material such as glass, and disposed on the top plate 100*a* of the casing. The original carriage reciprocates above the top plate 100*a* in the rightward direction a and in the leftward direction a'.

An original G is placed face down on the original carriage 1 at a predetermined reference position. Then, the original G is covered with an original cover 1*a*.

The top plate 100*a* is provided with a slit 100*b* formed extending perpendicularly to the reciprocal movement direction of the original supporting carriage 1 (perpendicular to the sheet of the drawing). The bottom surface of the original G placed on the carriage 1 sequentially passes by the slit 100*b* from the right side to the left side during the rightward stroke (a) of the original carriage 1. During the passage, the original G is illuminated with the light L from a lamp 7 through the slit 100*b* and the transparent original supporting platen 1. The light reflected by the original is projected onto a surface of a photosensitive drum 3 through a short focus small diameter imaging element array 2, as an image.

The photosensitive drum 3 has a photosensitive layer made of zinc oxide photosensitive material, an organic photoconductive material or the like. The photosensitive drum 3 is rotated in the clockwise direction b at a predetermined speed about the central axis 3*a*. During the rotation, the surface of the photosensitive drum 3 is uniformly charged by a charger 4 to a positive or negative polarity. Then, the surface is exposed to the light image through the slit, so that an electrostatic latent image is formed on the surface of the photosensitive drum 3.

The electrostatic latent image is sequentially developed by a developing device 5 with a powdery toner comprising a heat-fusible resin material or the like. The visualized image thus provided is fed to an image transfer station having a transfer discharger 8.

A recording material (transfer sheet P) is contained in a cassette S. The sheet in the cassette S is picked up one by one by a pick-up roller 6. Then, it is fed to the photosensitive member by registration rollers 9 in such a timed relation that a leading edge of the toner image on the drum 3 is aligned with the leading edge of the transfer sheet P arriving at the transfer station. The toner image is sequentially transferred from the photosensitive drum 3 to the surface of the sheet by a transfer discharger 8.

The sheet now having the transferred toner image is sequentially separated from the surface of the photosensitive drum 3 by an unshown separating means and is conveyed to an image fixing device 11 along a conveying guide 10. The fixing apparatus 11 which will be described in detail hereinafter heats the toner image to fix it. The transfer sheet is discharged to the sheet discharging tray 12 as a print (copy).

On the other hand, the surface of the photosensitive drum 3 after the toner image is transferred, is cleaned by a cleaning device 13, by which the residual toner or other contaminations are removed, and therefore, is prepared for the next-image forming operation.

The description will be made as to the fixing apparatus according to this embodiment. It comprises a fixing film 24 in the form of an endless belt. The endless belt 24 is stretched around parallel three members 25, 26 and 20, namely, a driving roller 25 (left side), a follower roller 26 (right side) and a heater 20 in the form of a line and having a low thermal capacity and disposed fixedly below a position between the rollers 25 and 26. The fixing film will be described in more detail hereinafter.

The follower roller 26 also functions as a tension roller for stretching the endless belt 24. When the driving roller 25 rotates in the clockwise direction, the fixing film 24 also rotates in the clockwise direction at a predetermined peripheral speed, that is, the same peripheral speed as the transfer sheet P (image bearing member) having the unfixed toner image Ta conveyed from the transfer discharge station 8. The fixing film is rotated without crease, snaking movement and without delay.

The driving roller 25 comprises a metal roller coated with a heat resistive material having a high friction coefficient relative to the inside surface of the film 24. The material may be silicone rubber or the like.

The follower roller 26 is made of a metal roller, and the frictional coefficient relative to the inside of the film 24 is lower than that of the driving roller 25.

A pressing roller 28 has a rubber elastic layer made of silicone rubber or the like having a good parting property. It cooperates with the bottom surface of the heater 20 to sandwich the bottom travel of the endless fixing film 24 with a total pressure of 4–7 kg, and it rotates codirectionally with the transfer sheet P, that is, in the counterclockwise direction.

The low thermal capacity linear heater 20 of this embodiment comprises a heater supporting member 27 which is elongated in a direction perpendicular to the movement direction of the fixing film 24 and which has a high rigidity, high heat durability and high heat insulating properties. It also comprises a heat generating element 22 integrally mounted on the bottom surface of the supporting member 27 and a temperature detecting element 23. The heat generating element, temperature detecting element 23 and an alumina base plate 21 constitute a heater board. The heater board has a high heat conductivity.

The heater supporting member, having a low thermal conductivity, functions to support the heater 20 on the fixing apparatus 11 and the entirety of the copying apparatus with heat insulating property therebetween. It may be made of PPS (polyphenylene sulfide), PAI (polyamide imide), PI (polyimide), PEEK (polyether ether ketone), a liquid crystal polymer or another highly heat resistive resin material, or a compound material of such resin and a ceramic material, metal or glass or the like.

Figure 3:
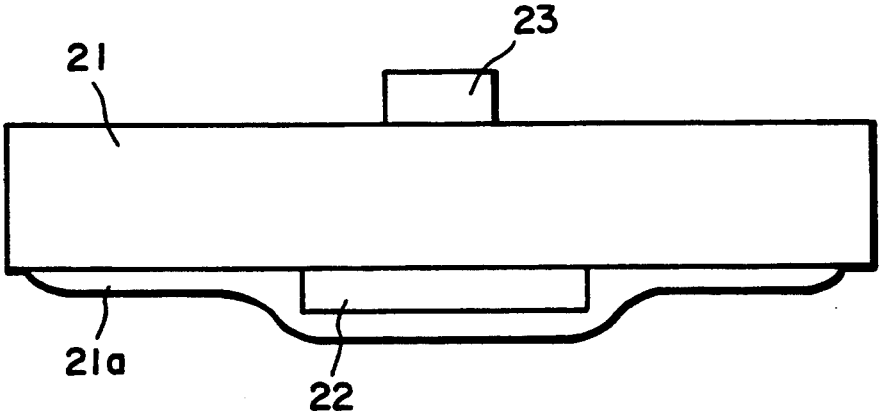
FIG. 3 is an enlarged sectional view of the heater.

FIG. 3 is an enlarged sectional view of the heater 20. As will be understood, the heat generating material 22 made of silver, palladium or the like and having a thickness of 10 microns and a width of 3 mm is screen printed and sintered on a substantially center line in the longitudinal direction of the alumina base plate 21 having a high thermal conductivity and having a thickness of 1.0 mm, a width of 10 mm and a length of 240 mm.

The heat generating resistor material 22 and the aluminum base plate 21 are coated with a protection layer 21*a*, and the fixing film 24 slides on the protection layer 21*a*. The protection layer 21*a* is provided by applying and sintering PTFE (polytetrafluoroethylene) dispersion into a thickness of 10 microns.

The temperature detecting element 23 is in the form of a thermister in this embodiment and is mounted on the bottom surface of the alumina base plate 21 with a heat-radiation silicone rubber bonding agent. In this embodiment, the linear heat generating element 22 is connected with a power source at the longitudinal opposite ends to be heated to approximately 200° C. uniformly along the length thereof. The power supply is controlled by an unshown power supply control circuit including a Triac such that the temperature detecting element 23 detects 200° C.

Figure 2:
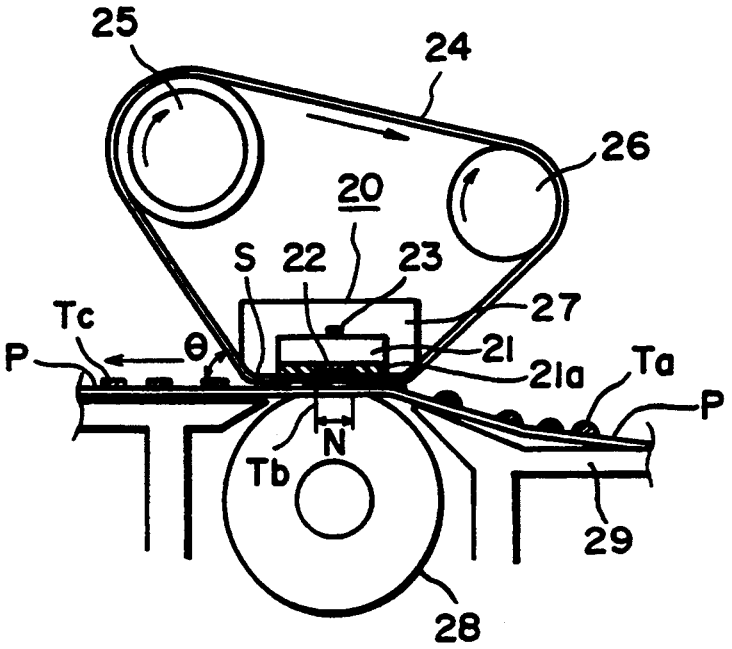
FIG. 2 is a sectional view of the heating apparatus used in FIG. 1 apparatus.

Referring to FIG. 2, the operation of the fixing apparatus will be described. Upon the image formation start signal produced, the image forming apparatus starts its image forming operation to produce an image on a transfer sheet P at the transfer station 8. The transfer sheet P is conveyed from the transfer station 8 to the fixing apparatus 11 with the toner image Ta carried on its top surface. The transfer sheet P is guided by the guide 29 into the nip N between the heater 20 and the pressing roller 28, more particularly, between the fixing film 24 and the pressing roller 28. It is moved together with the fixing film 24 with the unfixed toner image in contact with the fixing film 24 at the same speed as the conveying speed of the sheet P without the surface deviation or production of crease. In this manner, the transfer sheet is passed through the fixing nip N.

The heater 20 is energized at a predetermined timing in relation with the image formation start signal, and the temperature thereof instantaneously increases. The toner image Ta is heated at the nip N and is softened or fused into a softened or fused image Tb.

The traveling direction of the fixing film 24 is deflected at an acute angle ($\theta$=approximately 45 degrees) at an edge portion S having a large curvature of the supporting member 27 (the radius of the curvature is approximately 2 mm). Therefore, the sheet P having been passed through the nip N with overlapped relation with the fixing film 24, is separated due to the curvature change from the fixing film 24 at the edge portion S, and then is discharged to a sheet discharge tray 12.

The toner temperature is higher than the fusing point thereof at this point of separation. Until the sheet is discharged, the toner is sufficiently cooled and solidified, and therefore, is completely fixed on the sheet P into a fixed toner image Tc.

The toner used in this embodiment has such a high viscosity when heated and fused that even if the toner temperature is higher than the toner fusing point when it is separated from the fixing film 24, the coagulation force among toner particles is extremely larger than the toner adhesive force to the fixing film. Therefore, upon the separation between the fixing film 24 and the sheet P, the fixing film 24 is substantially free from the toner offset thereto.

In this embodiment, among the constituent elements of the heater 20, the heat generating element 22 and the board 21 have low thermal capacities, and they are supported on the supporting member 27 through insulation, and therefore, the surface temperature of the heater 20 at the nip N is increased to a sufficient level relative to the fusing point of the toner (the fixable temperature to the sheet P) in a short period of time. For this reason, it is not necessary to heat the heater beforehand (what is called stand-by temperature control), and therefore, the energy can be saved with the advantage of prevention of the temperature rise in the apparatus. In this embodiment, the film is driven at a speed of 50 mm/sec, and the pressing roller 28 is pressed to the heater with the total pressure of 8 kg.

The description Will be made as to the fixing film 24. It is in the form of a single layer or multi-layer film having a thickness of not more than 100 microns, preferably, not more than 40 microns, and having a heat resistivity, a good parting property and a good durability or the like.

Figure 4:
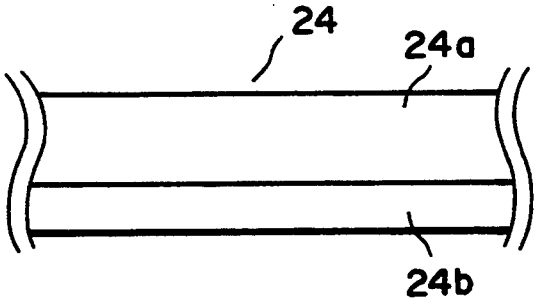
FIG. 4 is a sectional view of a film used in the heating apparatus of FIG. 2.

FIG. 4 is a sectional view of an example of a multi-layer film. It comprises a heat resistive layer **24*a* as a base layer (base film) of the fixing film, and a parting layer 24*b* on the outer side of the heat resistive layer 24*a*** (the side contactable to the toner image).

The heat resistive layer **24*a*** is of material having high strength and high heat durability such as highly heat resistive resin film such as polyimide, polyether ether ketone (PEEK), polyether sulfone (PES), polyether imide (PEI) or polyparbanic acid (PPA) or metal such as Ni, SUS or Al.

The parting layer **24*b* is preferably made of PTFE (polytetrafluoroethylene), PFA (perfluoroalkoxy), FEP or another fluorinated resin, or a silicone resin. The laminated structure of the heat resistive layer 24*a* and the parting layer 24*b*** may be accomplished by bonding lamination of the parting layer film, electrostatic printing of the parting layer material (coating), evaporation, CVD or another filming technique, or by co-extrusion of the heat resistive layer material and the parting layer material.

It is preferable that the surface resistance of the fixing film 24 is decreased by, for example, adding to the parting layer **24*b* material carbon black, graphite, conductive whisker or another conductive material, or by another method. By doing so, the toner contactable surface of the fixing film 24 is prevented from being electrically charged. Where the toner contactable surface of the fixing film 24 is insulative, the surface of the fixing film is electrically charged with the result of disturbance to the toner image on the sheet P, of the toner offset to the fixing film 24** (so-called charge offset). This can be avoided using the method described above.

The conductive material may be added to the base layer **24*a*. However, since the base layer 24*a*** requires high strength, and therefore, it is preferable that the conductive material is not added. Then, it remains insulative.

In this embodiment, a pure polyimide base film having a thickness of 15 microns was coated with a PTFE parting layer having a thickness of 5 microns through a primer coating. The parting layer contains 6% of carbon black to provide the resistivity of not more than $10^8$ ohm.cm.

The recording operation was carried out using the image forming apparatus of FIG. 1 using the fixing apparatus wherein the surface of the fixing film slidable on the heater is coated with fluorinated resin having a good parting property, the amount of scraping of the film was very low, and the film driving torque is hardly increased, until 50,000 sheets were processed.

By the provision of the resin material at the surface contactable to the heater, the smooth surface property can be provided, so that the wearing of the film due to the sliding can be reduced. Particularly, by using the fluorinated resin such as PTFE, PFA or FEP, the sliding property is improved, by which the torque for driving the film can be reduced. The resin layer may contain lubricant liquid such as oil to further improve the sliding property. It is preferable that the fluorinated resin, preferably porous fluorinated resin, contain fluorine oil having a high heat resistivity.

Another embodiment of the present invention will be described. The structure of this embodiment other than the protection layer is the same as the foregoing embodiment, and therefore, the detailed description is omitted for simplicity.

Where the protection layer is of a heat resistive resin, the surface thereof can be made smoother than that of glass, but the thermal conductivity of the heat resistive resin material is lower than that of glass.

Therefore, the efficiency of the heat transfer from the heat generating resistor 22 to the film decreases, and the difference between the surface temperature of the film at the recording material side and the temperature detected by the temperature detecting element, is increased so that the temperature control accuracy is degraded.

In this embodiment, the protection layer is compared of a PTFE resin in which 7 parts by weight of graphite is dispersed. The thermal conductivity of the graphite used is $2\times10^{-1}$ cal/sec/cm$^2$ °C./cm which is sufficiently larger than the thermal conductivity of the PTFE material which is $7\times10^{-4}$ cal/sec/cm$^2$ °C./cm (ASTMC 177).

Therefore, the thermal conductivity of the protection layer is increased, so that the efficiency of heat transfer from the heat generating resistor to the toner is improved. In addition, the temperature control accuracy at the surface of the film contactable to the toner is improved.

In order to reduce the thermal capacity of the protection layer **21*a***, the thickness thereof is preferably not more than 10 microns, and further preferably not more than 15 microns.

The usable material (heat resistive resin material), which is preferably resin paint having the heat resistivity of not less than 120° C. includes fluorinated resin such as PTFE, PFA or FEP, heat resistive resin paint of polyimide (melamine, epoxy resin). Particularly, however, the fluorinated resin is preferable for the reasons described in the foregoing (sliding property). When heat resistive resin other than the fluorinated resin is used, it is preferable that a solid lubricant material such as molybdenum disulfide or a heat resistive lubricant oil is contained.

The highly heat conductive material may be used, in addition to the graphite, carbon black, ketchen black or another low resistance material (carbon) or alumina or the like.

Particularly, low resistance carbon is preferable, and the amount is preferably 2–20 parts by weight. Then, the surface of the heater is prevented from being charged up by the sliding movement between the heater and the film. If the amount is smaller, the thermal conductivity is insufficient with the result of decreased heating efficiency. If it is larger, the slidability is decreased with the result of an increased driving torque and of the reduction of the surface resistivity of the protection layer which leads to leakage from the heat generating element.

In this embodiment wherein, the resistance between the electrodes for the heat generating element is 10 ohm, the surface resistance of the protection layer is preferably not less than $10^3$ ohm. The surface resistance of the protection layer is preferably not less than 100 times that of the heat generating element.

The polyimide is preferable as the resin paint from the standpoint of the high durability and high heat resistivity, but the thermal conductivity which is $4\times10^{-4}$ cal/sec/cm$^2$ °C./cm is lower than that of PTFE, and therefore, it is preferable to the pure polyimide that alumina having a thermal conductivity of $6\times10^{-2}$ cal/sec/cm$^2$ °C./cm or graphite having a thermal conductivity of $2\times10^{-1}$ cal/sec/cm$^2$ °C./cm be mixed.

The heat resistive resin preferably has a hardness less than that of the film in order to reduce the amount of wearing. The heat resistive resin for the protection layer preferably has the thermal conductivity of not less than $4\times10^{-4}$ cal/sec/cm$^2$ °C./cm. The dynamic friction coefficient relative to the inside of the film is preferably not more than 0.5.

As described in the foregoing, according to the present invention, the surface property of the protection layer is improved, so that the wearing of the film is reduced, and the close-contact between the heater and the film is improved by which the heating efficiency for the recording material is enhanced.

In addition, by containing the low resistance material in the protection layer to reduce the resistance of the protection layer, the charging-up of the heater attributable to the sliding with the film can be prevented. In addition, the manufacturing cost can be reduced since the temperature is lower in the resin sintering than in the glass sintering.

While the invention has been described with reference to the structures disclosed herein, it is not confined to the details set forth and this application is intended to cover such modifications or changes as may come within the purposes of the improvements or the scope of the following claims.

What is claimed is:

1. A heating apparatus, comprising:

a heater comprising a heat generating resistor element generating heat upon electric power supply thereto and a protection layer covering said heat generating resistor element; and a film in slidable contact with said protection layer and movable together with a recording material carrying thereon an image, wherein the image is heated by heat from said heat generating resistor element through said film, and wherein said protection layer is made of a resin material.

2. An apparatus according to claim 1, wherein said protection layer contains high thermal conductivity material.

3. An apparatus according to claim 1, wherein said heat generating resistor is formed on a base plate, and said protection layer extends on said base plate.

4. An apparatus according to claim 1, wherein the image is an unfixed image, and said apparatus heat-fixes the image.

5. An apparatus according to claim 1, wherein said protection layer has a thickness of not more than 40 microns.

6. An apparatus according to claim 5, wherein said protection layer has a thickness of not more than 15 microns.

7. An apparatus according to claim 1, wherein said protection layer has a dynamic friction coefficient relative to said film which is not more than 0.5.

8. An apparatus according to claim 2, wherein said protection layer has a thermal conductivity of not less than $4\times10^{-4}$ cal/sec/cm$^2$°C./cm.

9. An apparatus according to claim 1, wherein said protection layer has a surface resistance which is not less than 100 times a surface resistance of said heat generating resistor.

10. An apparatus according to claim 2, wherein the content of the high thermal conductivity material is 2–20% by weight.

11. An apparatus according to claim 1, wherein said protection layer contains oil.

12. An apparatus according to claim 1, wherein said protection layer is made of a fluorinated resin.

13. An apparatus according to claim 11, wherein said protection layer is porous.

14. An apparatus according to claim 11, wherein the oil is fluorine oil.

* * * * *

UNITED STATES PATENT AND TRADEMARK OFFICE

CERTIFICATE OF CORRECTION

PATENT NO. : 5,401,936
DATED : March 28, 1995
INVENTOR(S) : KENSAKU KUSAKA, ET AL.

It is certified that error appears in the above-indentified patent and that said Letters Patent is hereby corrected as shown below:

Column 2,
line 29, close up right margin; and
line 30, close up left margin.

Column 4,
line 18, "thermister" should read --thermistor--.

Column 6,
line 35, "compared" should read --composed--.

Signed and Sealed this

Twentieth Day of June, 1995

Bruce Lehman

*Attest:*

BRUCE LEHMAN

*Attesting Officer*

*Commissioner of Patents and Trademarks*